US010026598B2

(12) United States Patent
Gibbemeyer

(10) Patent No.: US 10,026,598 B2
(45) Date of Patent: Jul. 17, 2018

(54) SIGNAL AMPLITUDE MEASUREMENT AND CALIBRATION WITH AN ION TRAP

(71) Applicant: Rohde & Schwarz GmbH & Co. KG, Munich (DE)

(72) Inventor: Ralph Gibbemeyer, Neubiberg (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 244 days.

(21) Appl. No.: 14/987,742

(22) Filed: Jan. 4, 2016

(65) Prior Publication Data

US 2017/0194132 A1 Jul. 6, 2017

(51) Int. Cl.
*H01J 49/00* (2006.01)
*H01J 49/42* (2006.01)

(52) U.S. Cl.
CPC ..... *H01J 49/0009* (2013.01); *H01J 49/424* (2013.01)

(58) Field of Classification Search
CPC .. H01J 49/0009; H01J 49/4225; H01J 49/025; H01J 49/424
See application file for complete search history.

(56) References Cited

U.S. PATENT DOCUMENTS 5,479,012 A * 12/1995 Wells ..... H01J 49/0031 250/282
5,572,025 A * 11/1996 Cotter ..... H01J 49/0009 250/282
6,124,591 A * 9/2000 Schwartz ..... H01J 49/0009 250/282
6,195,031 B1 * 2/2001 Feld ..... H03M 1/188 341/120
6,229,142 B1 * 5/2001 Bateman ..... H01J 49/0036 250/287
6,831,275 B2 * 12/2004 Franzen ..... H01J 49/4225 250/282
7,038,200 B2 * 5/2006 Nikolaev ..... H01J 49/38 250/281

(Continued)

FOREIGN PATENT DOCUMENTS

JP 2011188352 A 9/2011
JP 2011192933 A 9/2011

(Continued)

*Primary Examiner* — David Porta
*Assistant Examiner* — Djura Malevic
(74) *Attorney, Agent, or Firm* — Potomac Technology Law, LLC

(57) ABSTRACT

Approaches for a measurement system for measuring or calibrating the amplitude of a signal of a signal generator, where the measurement system employs an ion trap, are provided. The measurement system comprises a signal generator operable to generate an output signal, and a measuring apparatus operable to determine an amplitude of the output signal. The measuring apparatus includes an ion trap operable to trap at least one ion, a signal supply device operable to supply the output signal of the signal generator to the ion trap, whereby a path of motion of the at least one trapped ion is influenced by the output signal, and a measuring device operable to determine the amplitude of the output signal based on a path of motion of the at least one trapped ion. The determined amplitude may be fed back to the signal generator for calibration purposes.

19 Claims, 4 Drawing Sheets

(56) References Cited

U.S. PATENT DOCUMENTS 7,238,936 B2 * 7/2007 Okamura ..... H01J 49/025 250/284
7,368,711 B2 * 5/2008 Franzen ..... H01J 49/38 250/291
7,423,259 B2 * 9/2008 Hidalgo ..... H03M 1/188 250/214 A
7,804,065 B2 * 9/2010 Remes ..... H01J 49/0009 250/290
8,178,835 B2 * 5/2012 Remes ..... H01J 49/005 250/282
8,198,582 B2 * 6/2012 Raptakis ..... H01J 49/24 250/281
8,258,462 B2 * 9/2012 Remes ..... H01J 49/0009 250/252.1
8,362,423 B1 * 1/2013 Verdu Galiana ..... H01J 49/422 250/291
8,508,397 B2 * 8/2013 Hisch ..... H03M 1/188 341/155
8,658,971 B2 * 2/2014 Green ..... G06K 9/0053 250/281
8,872,104 B2 * 10/2014 Langridge ..... H01J 49/025 250/281
9,324,545 B2 * 4/2016 Green ..... H01J 49/0009
2006/0118716 A1 * 6/2006 Michaud ..... H01J 49/4225 250/292
2010/0213361 A1 * 8/2010 Green ..... H01J 49/0036 250/252.1
2010/0270465 A1 * 10/2010 Raptakis ..... H01J 49/24 250/282
2011/0012013 A1 * 1/2011 Remes ..... H01J 49/0009 250/252.1
2011/0049353 A1 * 3/2011 Gilbert ..... G06K 9/0051 250/282
2013/0268212 A1 * 10/2013 Makarov ..... H01J 49/025 702/32
2013/0317756 A1 * 11/2013 Richardson ..... H01J 49/0036 702/23
2015/0136971 A1 * 5/2015 Green ..... H01J 49/0009 250/282

FOREIGN PATENT DOCUMENTS

JP 2011193400 A 9/2011
JP 2012195391 A 10/2012
WO WO 2013041615 A2 * 3/2013 ..... H01J 49/422
WO WO2013041615 A2 3/2013

* cited by examiner

SIGNAL AMPLITUDE MEASUREMENT AND CALIBRATION WITH AN ION TRAP

FIELD

The invention relates to a system and method for measuring and calibrating the amplitude of a signal produced by a signal generator based on the usage of an ion trap.

BACKGROUND ART

Currently, measurement systems, based on the utilization of an ion trap, appropriate for the purpose of measuring or calibrating the amplitude of an output signal produced by a signal generator are not known in the field. While the patent publication WO 2013/041615 A2 discloses a type of ion trap, referred to as a coplanar waveguide Penning trap, this publication does not disclose or suggest whether or how such an ion trap could be employed any such measurement system.

What is needed, therefore, is an approach for a measurement system appropriate for the purpose of measuring or calibrating the amplitude of a signal produced by a signal generator, where the measurement system is based on the use of an ion trap.

SUMMARY

Embodiments of the present invention advantageously address the foregoing requirements and needs, as well as others, by providing approaches for a measurement system and associated measurement methods for measuring or calibrating the amplitude of a signal produced by a signal generator, where the measurement system is based on the use of an ion trap.

In accordance with example embodiments, an apparatus for measuring an amplitude of an output signal of a signal generator is provided. The apparatus comprises an ion trap operable to trap at least one ion. The apparatus further comprises a signal supply device operable to supply the output signal to the ion trap, whereby a path of motion of the at least one trapped ion is influenced by the output signal. The apparatus further comprises a measuring device operable to determine the amplitude of the output signal based on the path of motion of the at least one trapped ion. Thus, employing an ion trap for the above-mentioned purpose will allow for very exact measuring and thus calibrating of the signal because of a high sensitivity of an ion trap to external influence such as the output signal. By way of example, the ion trap comprises one of a Penning trap and a Paul trap. By way of further example, the Penning trap may be based on superposition of a homogenous magnetic field and an inhomogeneous (e.g., a quadrupole electric field), and the Paul trap may be based on a single alternating electric field. By way of further example, the ion trap comprises a coplanar waveguide Penning trap.

In accordance with further example embodiments, an apparatus for calibrating a signal generator is provided. The apparatus comprises an ion trap operable to trap at least one ion. The apparatus further comprises a signal supply device operable to supply an output signal of the signal generator to the ion trap, whereby a path of motion of the at least one trapped ion is influenced by the output signal. The apparatus further comprises a measuring device operable to determine an amplitude of the output signal based on the path of motion of the at least one trapped ion, wherein the determined amplitude is fed-back to the signal generator for the purpose of calibration. By way of example, the ion trap comprises one of a Penning trap and a Paul trap. By way of further example, the Penning trap may be based on superposition of a homogenous magnetic field and an inhomogeneous (e.g., a quadrupole electric field), and the Paul trap may be based on a single alternating electric field. By way of further example, the ion trap comprises a coplanar waveguide Penning trap. According to one such embodiment, the amplitude of the output signal of the signal generator is adjusted in case of a deviation between a desired amplitude and the determined amplitude. Such embodiments of the calibration apparatus enable fully automatic calibration of the signal generator.

In accordance with further example embodiments, a measurement system is provided. The measurement system comprises a signal generator operable to generate an output signal, and a measuring apparatus operable to determine an amplitude of the output signal. The measuring apparatus includes an ion trap operable to trap at least one ion, a signal supply device operable to supply the output signal of the signal generator to the ion trap, whereby a path of motion of the at least one trapped ion is influenced by the output signal, and a measuring device operable to determine the amplitude of the output signal based on a path of motion of the at least one trapped ion. According to one embodiment, the determined amplitude may be fed back to the signal generator for calibration purposes. By way of example, the ion trap comprises one of a Penning trap and a Paul trap. By way of further example, the Penning trap may be based on superposition of a homogenous magnetic field and an inhomogeneous (e.g., a quadrupole electric field), and the Paul trap may be based on a single alternating electric field. By way of further example, the ion trap comprises a coplanar waveguide Penning trap. Measurement systems of such example embodiments provide for an integral system without significant limitation regarding size and portability. Further, according to one such embodiment, the amplitude of the output signal of the signal generator is adjusted in case of a deviation between a desired amplitude and the determined amplitude.

In accordance with further example embodiments, a measurement method for measuring an amplitude of an output signal of a signal generator is provided. The measurement method comprises supplying the output signal of the signal generator to an ion trap, wherein the ion trap traps at least one ion, whereby a path of motion of the at least one trapped ion is influenced by the output signal, and determining the amplitude of the output signal based on the path of motion of the at least one trapped ion. By way of example, the ion trap comprises one of a Penning trap and a Paul trap. By way of further example, the Penning trap may be based on superposition of a homogenous magnetic field and an inhomogeneous (e.g., a quadrupole electric field), and the Paul trap may be based on a single alternating electric field. By way of further example, the ion trap comprises a coplanar waveguide Penning trap.

In accordance with further example embodiments, a calibration method for calibrating a signal generator is provided. The calibration method comprises supplying an output signal of the signal generator to an ion trap, wherein the ion trap traps at least one ion, whereby a path of motion of the at least one trapped ion is influenced by the output signal. The calibration method further comprises determining an amplitude of the output signal based on the path of motion of the at least one trapped ion. The calibration method further comprises feeding the determined amplitude back to the signal generator for the purpose of calibration. By way of example, the ion trap comprises one of a Penning trap and a Paul trap. By way of further example, the Penning trap may be based on superposition of a homogenous magnetic field and an inhomogeneous (e.g., a quadrupole electric field), and the Paul trap may be based on a single alternating electric field. By way of further example, the ion trap comprises a coplanar waveguide Penning trap. According to a further embodiment, the calibration method further comprises adjusting the amplitude of the output signal of the signal generator in case of a deviation between a desired amplitude and the determined amplitude.

BRIEF DESCRIPTION OF THE DRAWINGS

The present invention is illustrated by way of example, and not by way of limitation, in the figures of the accompanying drawings, in which like reference numerals refer to similar elements, and in which.

DETAILED DESCRIPTION

Approaches for a measurement system and associated measurement methods for measuring or calibrating the amplitude of a signal produced by a signal generator, where the measurement system is based on the use of an ion trap, are described.

In accordance with example embodiments of the present invention, a Penning trap may be employed as an ion trap in a measurement system for the purpose of measuring or calibrating a signal provided by a signal generator, because a Penning trap is generally based on a magnetic and an electric field, where the two superposed fields are constant in each case (as opposed to a single alternating electric field with direct component, such as a Paul trap). The two constant superposed electric fields of a Penning trap leads an easier implementation compared with alternating fields. The following description primarily refers to example embodiments of the present invention that employ Penning traps, such as coplanar waveguide Penning traps. One of ordinary skill in the art, however, would recognize that other types of ion traps (e.g., Paul traps) may also be employed in such example embodiments without departing from the scope and subject matter regarded as the present invention.

Figure 1:
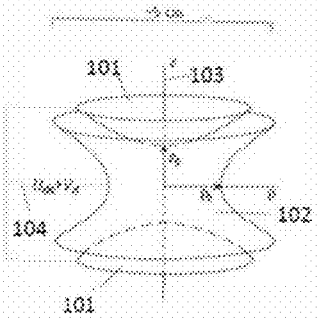
FIGS. 1(*a*), 1(*b*) and 1(*c*) show electrode configurations of ion traps.
Figure 1:
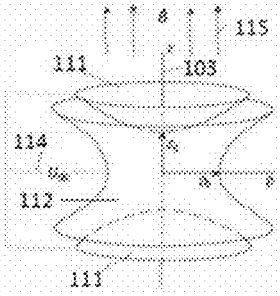
Figure 1:
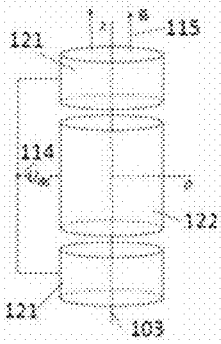

The core part of an ion trap is its electrode configuration. Accordingly, FIGS. 1(*a*), 1(*b*) and 1(*c*) show respective electrode configurations of example ion traps. FIG. 1(*a*) shows an example electrode configuration of a Paul trap, employing the application of a high frequency alternating voltage ($V_{rf}$) with direct component ($U_{dc}$) 104 between a ring electrode 102, with hyperbolical shape and shape factors $z_0$ and $\rho_0$, and two end cap electrodes 101. FIG. 1(*b*) illustrates a Penning trap with a hyperbolic ring electrode profile. The applied voltage between the ring electrode 112 and the end cap electrodes 111 of the Penning trap is a DC voltage ($U_{dc}$) 114 causing a constant electric field within the trap which is superposed by a homogenous magnetic field $\vec{B}$, wherein the magnetic field lines 115 are parallel to the direction of the z-axis 103. FIG. 1(*c*) illustrates a further example of an electrode profile for a Penning trap, where a DC voltage ($U_{dc}$) 114 is applied between a cylindrical ring electrode 122 and two cylindrical end cap electrodes 121. Generally, a cylindrical profile offers the advantage of a rather simple production and thus reduced manufacturing costs in contrast to a hyperbolical electrode profile. The inner constant electric field caused by the DC voltage 114 is superposed by a homogenous magnetic field 115 parallel to the direction of the z-axis 103. Further, the foregoing example electrode configurations of FIGS. 1(*a*), 1(*b*) and 1(*c*) are provided by way of example only, and not for limitation.

Figure 2:
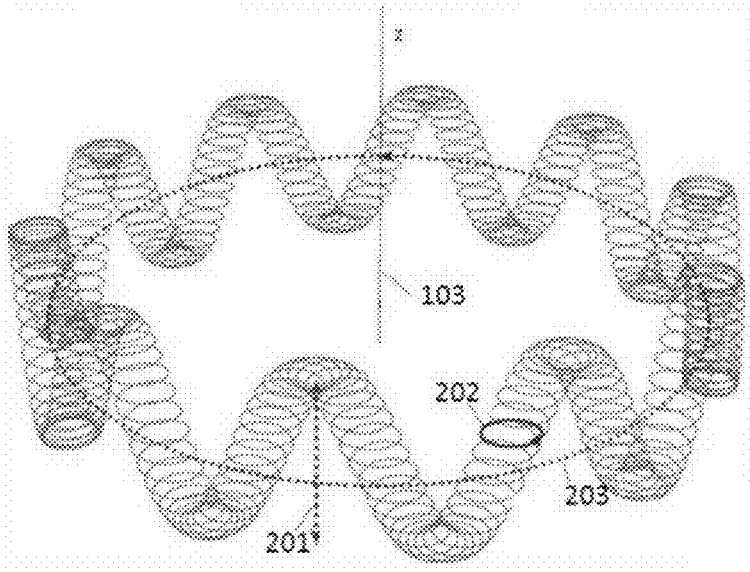
FIG. 2 shows three independent types of motion of an ion trapped in a Penning trap.

FIG. 2 illustrates the three different types of motion of an ion trapped in a Penning trap or in a coplanar waveguide Penning trap, in accordance with example embodiments of the present invention, which are due to superposition of a homogenous magnetic field and an inhomogeneous, typically quadrupole, electric field within the trap. With reference to FIG. 2, there is a harmonic oscillation 201 with angular frequency ω, in the direction of the z-axis 103, a radial motion around the magnetic field lines called cyclotron motion 202 with a so-called modified cyclotron frequency $\omega_+$, and a further radial motion around the trap center called magnetron motion 203 with magnetron frequency $\omega_-$.

Generally, an ion with charge-to-mass ratio q/m and velocity $\vec{v}$ trapped in a Penning trap or in a coplanar waveguide Penning trap with magnetic field $\vec{B}$ experiences a Lorentz force, as follows:

$$F_L = q \cdot \vec{v} \times \vec{B}.$$

This force confines the ion in the radial direction and causes a circular motion of the ion with angular frequency:

$$\omega_c = \frac{q}{m} \cdot |\vec{B}|,$$

which is called cyclotron frequency. There is a relationship between the cyclotron frequency $\omega_c$, the modified cyclotron frequency $\omega_+$, and the magnetron frequency $\omega_-$, which can be expressed as follows:

$$\omega_c = \omega_+ + \omega_-.$$

Furthermore, axial confinement is obtained by a static electric quadrupole potential:

$$V(z, \rho) = \frac{U_{dc}}{2d^2} \cdot \left(z^2 - \frac{1}{2}\rho^2\right),$$

where z and ρ are the axial and radial cylindrical coordinates and $U_{dc}$ is the DC voltage applied between the endcap 111 and ring electrodes 112 (e.g., as shown in FIG. 1*b*). Further, d is the characteristic dimension of the trap, for the hyperbolical trap, which applies:

$$d^2 = \frac{1}{2}\left(z_0^2 + \frac{\rho_0^2}{2}\right),$$

where $2\rho_0$ and $2z_0$ are the inner ring diameter and the closest distance between the endcap electrodes 111 (cf. FIG. 1*b*).

The equations of motion of the trapped ion are as follows:

$$m\ddot{\vec{z}} = q\vec{E}_z$$

and $$m\ddot{\vec{\rho}} = q(\vec{E}_\rho + \vec{\rho} \times \vec{B})$$

with the electric field strengths $$E_z = \frac{U_{dc}}{d^2} z$$

and $$E_\rho = \frac{U_{dc}}{2d^2} \rho.$$

Solving the equations of motion, one obtains the three independent motional modes as shown in FIG. 2: a harmonic oscillation 201 along the z-axis 103 with frequency $$\omega_z = \sqrt{\frac{qU_{dc}}{md^2}},$$

the modified cyclotron frequency $$\omega_+ = \frac{\omega_c}{2} + \sqrt{\frac{\omega_c^2}{4} - \frac{\omega_z^2}{2}},$$

and the magnetron frequency $$\omega_- = \frac{\omega_c}{2} - \sqrt{\frac{\omega_c^2}{4} - \frac{\omega_z^2}{2}}.$$

However, for measuring and thus also for calibrating an amplitude of an output signal of a signal generator, the output signal has to be supplied to the ion trap, such that the path of motion of at least one trapped ion is influenced by the output signal. Afterwards, the amplitude of the output signal can be determined on the basis of the path of motion of the at least one trapped ion and the signal generator can be calibrated when required.

Figure 3:
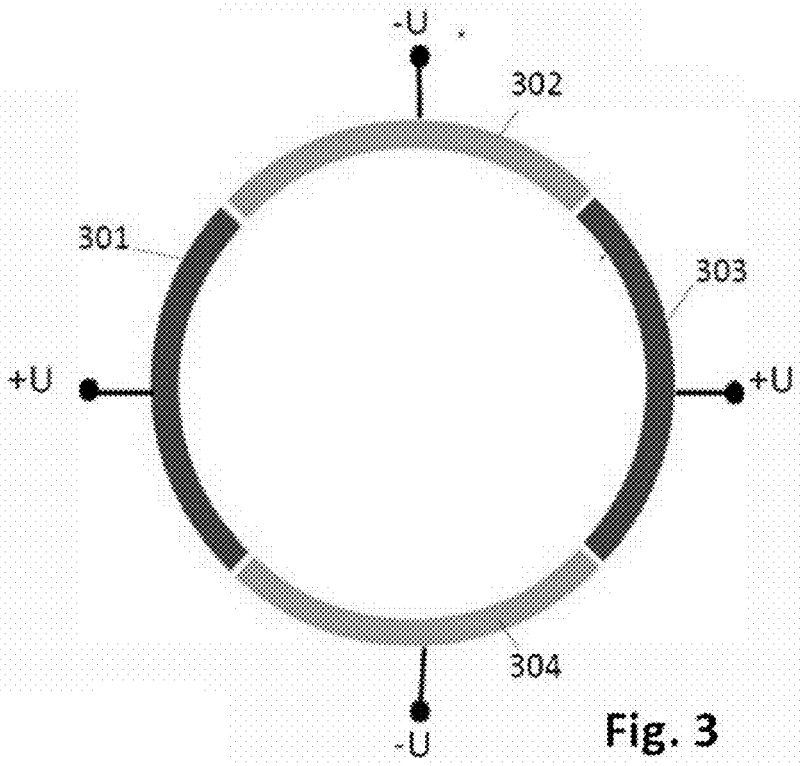
FIG. 3 shows a typical radial segmentation of the ring electrode of an ion trap for quadrupole excitation.

By way of example only, and not for limitation, supplying an output signal of a signal generator to a Penning trap or to a coplanar Penning trap in order to measure its amplitude exactly can be achieved by applying so-called quadrupole excitation. For quadrupole excitation, the ring electrode 112 (or 122) of an ion trap is segmented into four parts, e.g. according to FIG. 3, which shows a typical radial segmentation of the ring electrode of an ion trap for quadrupole excitation. Further, a radio frequency signal is applied to the four ring segments 301 to 304 in that way that two opposite segments 301, 303 and 302, 304 are supplied with the same phase of the radio frequency signal. Additionally, the radio frequency signal is correlated with the output signal, the amplitude of which is to be measured.

Further, for measuring the amplitude of an output signal of a signal generator with the aid of an ion trap, it is necessary to find a motion parameter of the at least one trapped ion—directly or indirectly influenced by the output signal—which is correlated with the amplitude of the output signal of the signal generator. By way of example only, and not for limitation, the derivation of such a parameter is described in the following paragraphs.

In general, quadrupole excitation comprises irradiation of an azimuthal quadrupole field with the following electric field components (in the direction of the x-axis and the y-axis)

$$E_x = E \cdot y \cdot \cos(\omega t)$$

and $$E_y = E \cdot x \cdot \cos(\omega t),$$

where the electric field amplitude E is correlated with the amplitude of the output signal to be determined, x is a x-coordinate, y is a y-coordinate, ω is the angular frequency of excitation, and t is time.

Further, the irradiation of an azimuthal quadrupole field leads to a coupling of magnetron motion 203 and modified cyclotron motion 202. This may further cause a periodic conversion between these two radial motions. For instance, starting from a pure magnetron motion with magnetron radius $\rho_- = \rho_0$ and modified cyclotron radius $\rho_+ = 0$, it may result in a pure modified cyclotron motion with $\rho_- = 0$ and $\rho_+ = \rho_0$. One conversion needs the time $$T = \frac{m}{q} \cdot \frac{1}{E} \cdot \pi(\omega_+ - \omega_-),$$

which depends—besides the type of the trapped ion—on E, which is, as described above, correlated with the amplitude of the signal to be measured and optionally to be calibrated. Therefore, by way of example only, and not for limitation, with the aid of determining the time T needed for one conversion between magnetron and modified cyclotron motion caused by quadrupole excitation on the basis of the output signal of the signal generator, it is possible to measure—and thus also to calibrate—the amplitude of the output signal.

Figure 4:
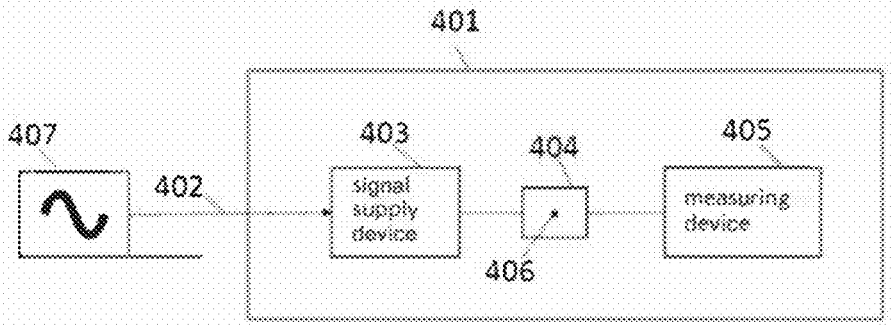
FIG. 4 shows a block diagram of a measurement system, in accordance with example embodiments.

FIG. 4 shows a block diagram of a measurement system, in accordance with example embodiments of the present invention. With reference to FIG. 4, the measurement system 401 may be employed for the measurement of an amplitude of an output signal 402 of a signal generator 407, wherein the output signal 402 of the signal generator 407 is passed to the signal supply device 403 of the measurement system 401. The signal supply device 403 supplies the output signal 402 of the signal generator 407 to an ion trap 404, such that the path of motion of at least one trapped ion 406 is influenced by the output signal 402. By way of example only, and not for limitation, influencing the at least one trapped ion 406 can be achieved by quadrupole excitation as described above.

Influencing the path of motion of the ion 406, for instance, by an alternating magnetic field would be also conceivable. For measuring the amplitude, it is necessary to determine at least one motion parameter of the ion 406 with the aid of the measuring device 405, which depends on the amplitude of the output signal 402 of the signal generator 407. By way of example only, and not for limitation, an appropriate parameter to be determined regarding motion of the ion 406 is the above-mentioned amplitude-dependent time T which is needed for one conversion between magnetron and modified cyclotron motion caused by quadrupole excitation on the basis of the output signal of the signal generator.

Figure 5:
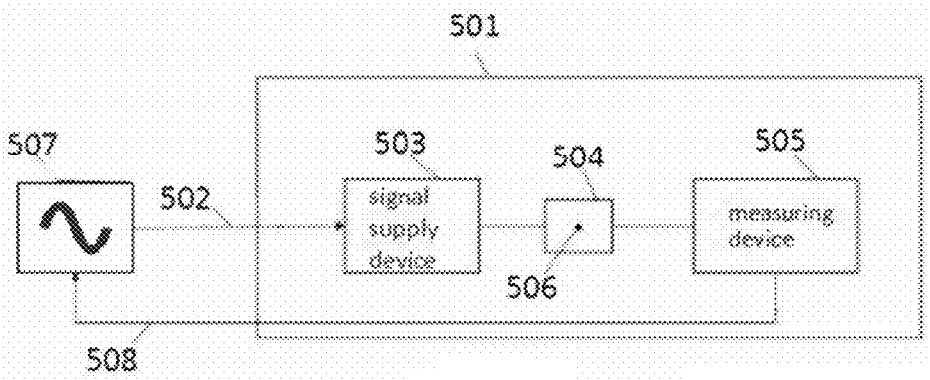
FIG. 5 shows block diagram of a calibration system, in accordance with example embodiments.

FIG. 5 shows block diagram of a calibration system, in accordance with example embodiments of the present invention. With reference to FIG. 5, the calibration system 501 comprises an ion trap 504 for trapping at least one ion 506, a signal supply device 503, and measuring device 505. Analogous to the embodiment of FIG. 4, an output signal 502 of a signal generator 507 is passed to the signal supply device 503 for supplying the ion trap 504 by way of example only, and not limitation, in the sense of the above-mentioned quadrupole excitation—directly or indirectly—caused by the output signal 502. Determining an appropriate parameter regarding motion or behavior of the trapped ion 506 with the aid of the measuring device 505, wherein this parameter is dependent on the amplitude of the output signal such as the above-mentioned time T needed for one conversion between magnetron and modified cyclotron motion caused by quadrupole excitation on the basis of the output signal of the signal generator, allows for an exact measurement of the amplitude of the output signal. After the amplitude to be determined has been measured, the measured value may be fed back to the signal generator 507 for the purpose of calibration with the aid of a feedback channel 508. In case of a deviation between a desired amplitude value set on the signal generator 507 and the determined fed back amplitude value, the amplitude of the output signal 502 of the signal generator 207 can be adjusted manually or automatically.

Figure 6:
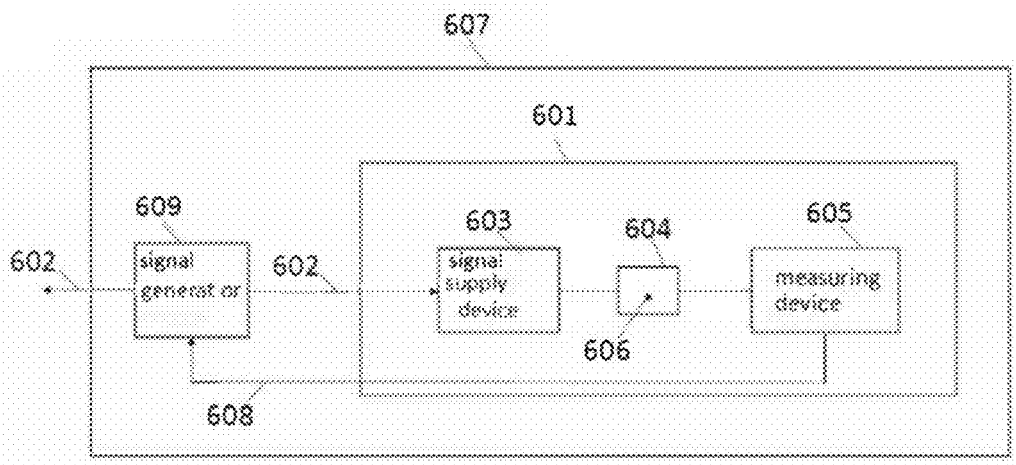
FIG. 6 shows a block diagram of a measurement/calibration system with a signal generator comprising signal generator for providing the signal for measurement/calibration, in accordance with example embodiments.

FIG. 6 shows a block diagram of a measurement/calibration system with a signal generator comprising signal generator for providing the signal for measurement/calibration, in accordance with example embodiments of the present invention. The calibration system 601 is integrated into a signal generator 607 comprising—besides the calibration system 601—signal generator 609 for generating an output signal 602 which is internally passed to the signal supply device 603 of the calibration system 601. Analogous to the embodiment of the calibration system according to FIG. 5, the calibration system 601 comprises—besides the signal supply device 603—an ion trap 604 for trapping at least one ion 606, and measuring device 605 for determining the amplitude of the output signal 602 on the basis of the path of motion of the at least one trapped ion 606 influenced by the output signal 602. Further, determining the amplitude of the output signal 602 is achieved in a manner analogous to the explanations above. After the amplitude to be determined has been measured, the measured value is fed back to the signal generator 609 for the purpose of calibration with the aid of a feedback channel 608. In case of a deviation between a desired amplitude value set on the signal generator 607 and the determined fed back amplitude value, the amplitude of the output signal 602 of the signal generator 607 will be adjusted manually or automatically. This enables, for instance, to provide a self-calibrating signal generator.

Figure 7:
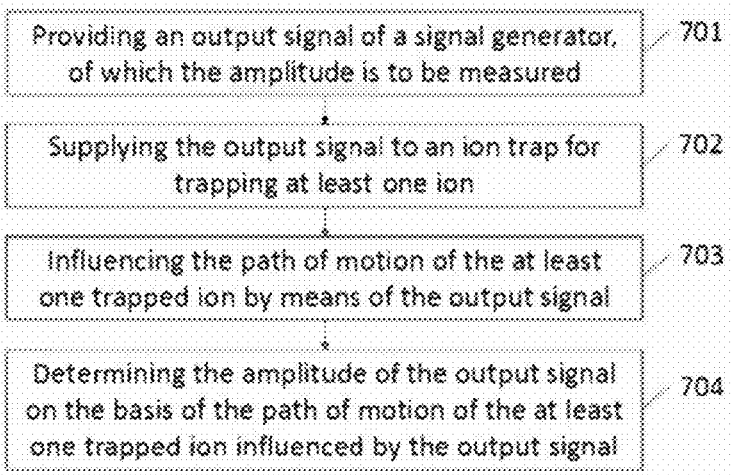
FIG. 7 shows a flow chart of a measurement method, in accordance with example embodiments.

FIG. 7 shows a flow chart of a measurement method, in accordance with example embodiments of the present invention. In a first step 701, an output signal of a signal generator, of which the amplitude is to be measured, is provided. In a second step 702, the output signal is supplied to an ion trap for trapping at least one trapped ion, such that, in a third step 703, the path of motion of the at least one trapped ion is influenced by the output signal. Finally, in a fourth step 704, the amplitude of the output signal is determined on the basis of the path of motion of the at least one trapped ion influenced by the output signal of the signal generator.

Figure 8:
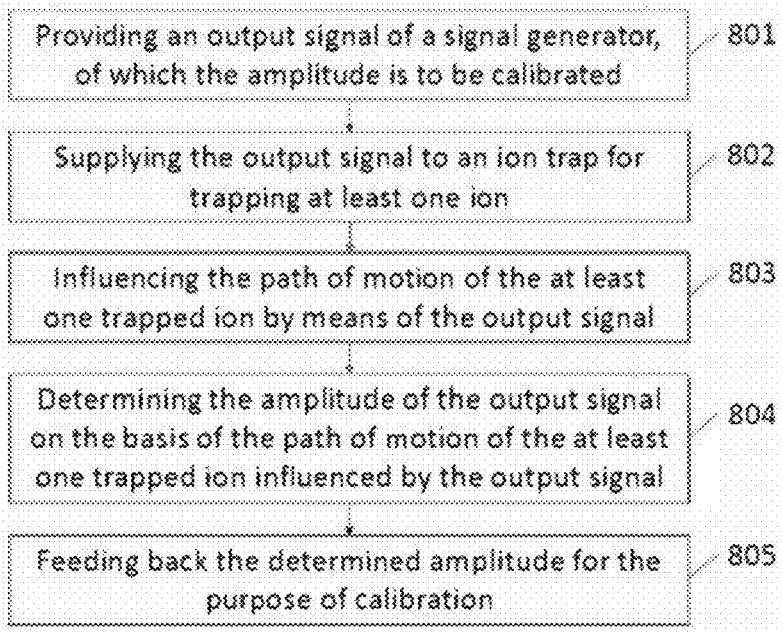
FIG. 8 shows a flow chart of a calibration method, in accordance with example embodiments.

FIG. 8 shows a flow chart of a calibration method, in accordance with example embodiments of the present invention. The steps 801 to 804 of FIG. 8 are analogous the steps 701 to 704 of FIG. 7. Further, in a fifth step 805. The amplitude determined in the fourth step 804 of an output signal of a signal generator is fed back to the signal generator for the purpose of calibration.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

What is claimed is:

1. An apparatus for measuring an amplitude of an output signal of a signal generator, wherein the apparatus comprises:

an ion trap operable to trap at least one ion;

a signal supply device operable to supply the output signal to the ion trap, whereby a path of motion of the at least one trapped ion is influenced by the output signal; and a measuring device operable to determine the amplitude of the output signal based on the path of motion of the at least one trapped ion, wherein the amplitude of the output signal is determined using a determined time needed for one conversion between a magnetron motion and a modified cyclotron motion caused by excitation based on the output signal.

2. The apparatus of claim 1, wherein the ion trap comprises one of a Penning trap and a Paul trap.

3. The apparatus of claim 1, wherein the ion trap comprises a coplanar waveguide Penning trap.

4. An apparatus for calibrating a signal generator, wherein the apparatus comprises:

an ion trap operable to trap at least one ion;

a signal supply device operable to supply an output signal of the signal generator to the ion trap, whereby a path of motion of the at least one trapped ion is influenced by the output signal;

a measuring device operable to determine an amplitude of the output signal based on the path of motion of the at least one trapped ion, wherein the amplitude of the output signal is determined using a determined time needed for one conversion between a magnetron motion and a modified cyclotron motion caused by excitation based on the output signal, and wherein the determined amplitude is fed-back to the signal generator for the purpose of calibration.

5. The apparatus of claim 4, wherein the ion trap comprises one of a Penning trap and a Paul trap.

6. The apparatus of claim 4, wherein the ion trap comprises a coplanar waveguide Penning trap.

7. The apparatus of claim 4, wherein the amplitude of the output signal of the signal generator is adjusted in case of a deviation between a desired amplitude and the determined amplitude.

8. A measurement system comprising:

a signal generator operable to generate an output signal; and a measuring apparatus operable to determine an amplitude of the output signal, wherein the measuring apparatus includes an ion trap operable to trap at least one ion, a signal supply device operable to supply the output signal of the signal generator to the ion trap, whereby a path of motion of the at least one trapped ion is influenced by the output signal, and a measuring device operable to determine the amplitude of the output signal based on a path of motion of the at least one trapped ion; and wherein the amplitude of the output signal is determined using a determined time needed for one conversion between a magnetron motion and a modified cyclotron motion caused by excitation based on the output signal.

9. The measurement system of claim 8, wherein the determined amplitude is fed back to the signal generator for the purpose of calibration.

10. The measurement system of claim 8, wherein the ion trap comprises one of a Penning trap and a Paul trap.

11. The measurement system of claim 8, wherein the ion trap comprises a coplanar waveguide Penning trap.

12. The measurement system of claim 9, wherein the amplitude of the output signal of the signal generator is adjusted in case of a deviation between a desired amplitude and the determined amplitude.

13. A measurement method for measuring an amplitude of an output signal of a signal generator, wherein the measurement method comprises:

supplying the output signal of the signal generator to an ion trap, wherein the ion trap traps at least one ion, whereby a path of motion of the at least one trapped ion is influenced by the output signal; and determining the amplitude of the output signal based on the path of motion of the at least one trapped ion, wherein the amplitude of the output signal is determined using a determined time needed for one conversion between a magnetron motion and a modified cyclotron motion caused by excitation based on the output signal.

14. The measurement method of claim 13, wherein the ion trap comprises one of a Penning trap and a Paul trap.

15. The measurement method of claim 13, wherein the ion trap comprises a coplanar waveguide Penning trap.

16. A calibration method for calibrating a signal generator, wherein the calibration method comprises:

supplying an output signal of the signal generator to an ion trap, wherein the ion trap traps at least one ion, whereby a path of motion of the at least one trapped ion is influenced by the output signal;

determining an amplitude of the output signal based on the path of motion of the at least one trapped ion, wherein the amplitude of the output signal is determined using a determined time needed for one conversion between a magnetron motion and a modified cyclotron motion caused by excitation based on the output signal; and feeding the determined amplitude back to the signal generator for the purpose of calibration.

17. The calibration method of claim 16, wherein the ion trap ion trap comprises one of a Penning trap and a Paul trap.

18. The calibration method of claim 16, wherein the ion trap comprises a coplanar waveguide Penning trap.

19. The calibration method of claim 16, further comprising:

adjusting the amplitude of the output signal of the signal generator in case of a deviation between a desired amplitude and the determined amplitude.

* * * * *